US010406532B2

(12) United States Patent
Kaartinen et al.

(10) Patent No.: US 10,406,532 B2
(45) Date of Patent: Sep. 10, 2019

(54) METHOD AND AN ARRANGEMENT FOR CONTROLLING OF A COMMINUTION PROCESS HAVING A GRINDING CIRCUIT

(71) Applicant: OUTOTEC (FINLAND) OY, Espoo (FI)

(72) Inventors: Jani Kaartinen, Kuopio (FI); Ari Rantala, Porvoo (FI); Antti Remes, Espoo (FI); Ville Suontaka, Helsinki (FI); Jari Moilanen, Espoo (FI); Pertti Saviranta, Helsinki (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/779,154

(22) PCT Filed: Nov. 30, 2016

(86) PCT No.: PCT/FI2016/050844
§ 371 (c)(1),
(2) Date: May 25, 2018

(87) PCT Pub. No.: WO2017/093610
PCT Pub. Date: Jun. 8, 2017

(65) Prior Publication Data

US 2018/0369829 A1 Dec. 27, 2018

(30) Foreign Application Priority Data

Dec. 1, 2015 (FI) ..... 20155908

(51) Int. Cl.
*B02C 25/00* (2006.01)
*B02C 23/02* (2006.01)
(Continued)

(52) U.S. Cl.
CPC ..... *B02C 25/00* (2013.01); *B02C 21/00* (2013.01); *B02C 23/02* (2013.01); *B02C 23/10* (2013.01); *B02C 23/14* (2013.01)

(58) Field of Classification Search
CPC ..... B02C 25/00; B02C 23/10; B02C 23/14; B02C 23/02; B02C 21/00
See application file for complete search history.

(56) References Cited

U.S. PATENT DOCUMENTS 4,288,162 A 9/1981 Sakamoto et al.
4,728,044 A * 3/1988 Duill ..... B02C 23/18 241/152.2
(Continued)

FOREIGN PATENT DOCUMENTS

CN 101027553 A 8/2007
CN 102076417 A 5/2011
(Continued)

OTHER PUBLICATIONS

International Search Report issued by the European Patent Office acting as the International Searching Authority in relation to International Patent Application No. PCT/FI2016/050844 dated May 8, 2017 (6 pages).
(Continued)

*Primary Examiner* — Faye Francis
(74) *Attorney, Agent, or Firm* — Robert P. Michal, Esq.; Carter, DeLuca & Farrell LLP

(57) ABSTRACT

An arrangement for controlling a comminution process having a grinding circuit, includes an imaging system measuring 3D reconstruction measurement data for three-dimensional reconstruction of incoming ore; a particle size analysis equipment measuring particle size data for calculation of the particle size characteristic value of outgoing ore; an ore characteristics data calculation block receiving a particle size distribution profile of incoming ore and a particle size
(Continued)

characteristic value of the outgoing ore, the particle size distribution profile being calculated and/or reconstructed from the 3D reconstruction measurement data for three-dimensional reconstruction, and the particle size characteristic value being calculated based on the measured particle size data, the ore characteristics data calculation block calculating ore characteristics data based on the particle size distribution profile and the particle size characteristic value; and a control block controlling the grinding circuit based on the calculated ore characteristics data.

15 Claims, 10 Drawing Sheets

(51) Int. Cl.

| | |
|---|---|
| ***B02C 21/00*** | (2006.01) |
| ***B02C 23/10*** | (2006.01) |
| ***B02C 23/14*** | (2006.01) |

(56) References Cited

U.S. PATENT DOCUMENTS

| | | | | |
|---|---|---|---|---|
| 5,437,418 | A * | 8/1995 | Graef | A61F 13/15707 241/152.2 |
| 5,519,793 | A | 5/1996 | Grannes | |
| 6,885,904 | B2 * | 4/2005 | Lieber | G05B 15/02 700/109 |
| 8,215,575 | B2 * | 7/2012 | Palin | B01J 20/041 241/135 |
| 8,770,501 | B2 * | 7/2014 | Laukka | B02C 25/00 241/152.2 |
| 2002/0170367 | A1 | 11/2002 | Lieber et al. | |
| 2004/0189991 | A1 | 9/2004 | Canty et al. | |
| 2009/0245616 | A1 | 10/2009 | De La Ballina et al. | |
| 2013/0026263 | A1 * | 1/2013 | Bamber | B07C 5/344 241/24.1 |
| 2013/0309524 | A1 | 11/2013 | Vietz et al. | |
| 2015/0144718 | A1 * | 5/2015 | Hunker | B02C 19/0012 241/5 |

FOREIGN PATENT DOCUMENTS

| | | | |
|---|---|---|---|
| CN | 104607301 | A | 5/2015 |
| SU | 1748872 | A1 | 7/1992 |

OTHER PUBLICATIONS

Written Opinion of the International Searching Authority issued by the European Patent Office acting as the International Searching Authority in relation to International Patent Application No. PCT/FI2016/050844 dated May 8, 2017 (10 pages).

International Preliminary Report issued by the European Patent Office acting as the International Preliminary Examining Authority in relation to International Patent Application No. PCT/FI2016/050844 dated Jan. 19, 2018 (7 pages).

Remes, A. et al. Grinding circuit modeling and simulation of particle size control at Siilinjarvi concentrator. International Journal of Mineral Processing. vol. 96, No. 1-4, 2010. pp. 70-78. EPOQUENET NPL: XP027206996.

Gomez, M. et al. Epipolar geometry estimation for cameras with general disposition configuration. 3rd IEEE International Conference on Industrial Informatics (INDIN). Perth, Australia. Aug. 10-12, 2005. pp. 599-604. ISBN 978-0-7803-9094-2; ISBN 0-7803-9094-6. EPOQUENET NPL: XP010865309.

Thurley, M. J. Automated online measurement of limestone particle size distributions using 3D range data. Journal of Process Control. vol. 21, No. 2, 2011. pp. 254-262. EPOQUENET NPL: XP028161790.

Lanaro, F. et al. 3D characterization of coarse aggregates. Engineering Geology. vol. 65, No. 1, 2002. pp. 17-30. EPOQUENET NPL: XP004352838.

Lee, J.R.J. et al. A new approach to the three-dimensional quantification of angularity using image analysis of the size and form of coarse aggregates. Engineering Geology. vol. 91, No. 2-4, 2007, pp. 254-264. EPOQUENET NPL: XP025959779.

Mattila, M. et al. Application of multivariate process control on particle size analyzer. 2005 IEEE International Symposium on Computational Intelligence in Robotics and Automation. Espoo, Finland. Jun. 27-30, 2005. pp. 519-524. ISBN 978-0-7803-9355-4; ISBN 0-7803-9355-4. EPOQUENET NPL: XP010861051.

Al-Thyabat, S. et al. Estimation of the size distribution of particles moving on a conveyor belt. Minerals Engineering. vol. 20, No. 1, 2007, pp. 72-83. EPOQUENET NPL: XP005783394.

Finnish Search Report issued by the Finnish Patent and Registration Office in relation to Finnish Application No. 20155908 dated Apr. 15, 2016 (2 pages).

Wills, Barry A., Wills' Mineral Processing Technology: An Introduction to the Practical Aspects of Ore Treatment and Mineral Recovery, Eighth Edition, 8 pages.

Chinese Office Action issued by the China National Intellectual Property Administration in relation to Chinese Application No. 201680069847.2 dated May 31, 2019 (5 pages) along with English language translation (6 pages).

* cited by examiner

METHOD AND AN ARRANGEMENT FOR CONTROLLING OF A COMMINUTION PROCESS HAVING A GRINDING CIRCUIT

CROSS-REFERENCE TO RELATED APPLICATIONS

This application is a national phase entry under 35 U.S.C. 371 of PCT International Application No. PCT/FI2016/050844 filed Nov. 30, 2016, which claims priority to Finnish Patent Application No. 20155908, filed Dec. 1, 2015, the disclosure of each of these applications is expressly incorporated herein by reference in their entirety.

FIELD OF THE INVENTION

The present invention relates to the field of mineral and metallurgical processes, to comminution processing or disintegrating in general and to comminution processing by crushers and tumbling mills, and more particularly to a method and arrangement for controlling of a comminution process having a grinding circuit.

BACKGROUND OF THE INVENTION

One of the most common processes in mining and metallurgy is the comminution processing or disintegrating of ore. Comminution is achieved by blasting, crushing and grinding.

When operating a grinding circuit of a comminution process, changing ore characteristics result to variation in grinding capacity, produced particle size distribution and energy consumption per processed tons of ore. Due to high operating costs and value of material flow, optimizing the operation of a grinding circuit of a comminution process has a high economic impact on performance of a mineral processing plant.

In general, there are some problems with the prior art solutions for controlling of a comminution process. The problem therefore is to find a more reliable and accurate solution for controlling of a comminution process.

There is a demand in the market for a method for controlling of a comminution process which method would provide a better controlled comminution process when compared to the prior art solutions. Likewise, there is a demand in the market for an arrangement for controlling of a comminution process which arrangement would have a better controlled comminution process when compared to the prior art solutions.

BRIEF DESCRIPTION OF THE INVENTION

An object of the present invention is thus to provide a method and an arrangement so as to overcome the above problems and to alleviate the above disadvantages.

The objects of the invention are achieved by a method for controlling a comminution process having a grinding circuit, which method comprises steps of:

- measuring 3D reconstruction measurement data for three-dimensional reconstruction of incoming ore to said grinding circuit with an imaging system;
- measuring particle size data for calculation of the particle size characteristic value of outgoing ore from said grinding circuit a particle size analysis equipment;
- receiving a particle size distribution profile of incoming ore said particle size distribution profile of incoming ore being calculated and/or reconstructed from said 3D reconstruction measurement data for three-dimensional reconstruction;
- receiving a particle size characteristic value of the outgoing ore said particle size characteristic value of the outgoing ore being calculated based on said measured particle size data;
- calculating ore characteristics data based on said particle size distribution profile and said particle size characteristic value, said ore characteristics data identifying ore characteristics, such as e.g. the ore hardness; and
- controlling the grinding circuit in said comminution process based on said calculated ore characteristics data.

Preferably, said method comprises steps of:

- reconstructing a three-dimensional reconstruction of incoming ore from said 3D reconstruction measurement data for three-dimensional reconstruction; and
- calculating a particle size distribution profile of incoming ore based on said three-dimensional reconstruction of incoming ore.

Preferably, said method comprises a step of calculating the particle size characteristic value of the out-going ore based on said measured particle size data.

Preferably in the method, said grinding circuit comprises:

- at least two groups of grinding mills arranged in series, each one of said at least two groups or grinding mills comprising an at least one grinding mill; and
- an at least one classification block, each one of said at least one classification block comprising an at least one classification sorter.

Preferably in the method, said incoming ore is conveyed by a conveyor, and that said imaging system is placed in the vicinity of said conveyor.

Preferably, said method comprises a step of receiving comminution process data for controlling said comminution process, said comminution process data including one or more of the following data: ore mass feed, density, water addition, ball addition, pebbles feed, grinding mill speed, grinding product size, grinding mill power draw, grinding mill torque, grinding mill bearing pressure and grinding mill charge.

Preferably, said method comprises a step of calculating control value data for controlling a crushing circuit and/or for controlling a grinding circuit. Preferably, said method comprises a step of sending control signalling and/or data signalling to a crushing circuit and/or to a grinding circuit.

Furthermore, the objects of the invention are achieved by a method for controlling a comminution process having a grinding circuit, which method comprises steps of:

- measuring 3D reconstruction measurement data for three-dimensional reconstruction of incoming ore to said grinding circuit with an imaging system;
- measuring particle size data for calculation of the particle size characteristic value of outgoing ore from said grinding circuit a particle size analysis equipment;
- receiving a particle size distribution profile of incoming ore said particle size distribution profile of incoming ore being calculated and/or reconstructed from said 3D reconstruction measurement data for three-dimensional reconstruction; and
- receiving a particle size characteristic value of the outgoing ore said particle size characteristic value of the outgoing ore being calculated based on said measured particle size data.

Preferably, said method comprises steps of:

reconstructing a three-dimensional reconstruction of incoming ore from said 3D reconstruction measurement data for three-dimensional reconstruction; and calculating a particle size distribution profile of incoming ore based on said three-dimensional reconstruction of incoming ore.

Preferably, said method comprises a step of calculating the particle size characteristic value of the out-going ore based on said measured particle size data.

Preferably in the method, said grinding circuit comprises:

at least two groups of grinding mills arranged in series, each one of said at least two groups or grinding mills comprising an at least one grinding mill; and an at least one classification block, each one of said at least one classification block comprising an at least one classification sorter.

Preferably in the method, said incoming ore is conveyed by a conveyor, and that said imaging system is placed in the vicinity of said conveyor.

Preferably, said method comprises a step of receiving comminution process data for controlling said comminution process, said comminution process data including one or more of the following data: ore mass feed, density, water addition, ball addition, pebbles feed, grinding mill speed, grinding product size, grinding mill power draw, grinding mill torque, grinding mill bearing pressure and grinding mill charge.

Preferably, said method comprises a step of calculating control value data for controlling a crushing circuit and/or for controlling a grinding circuit. Preferably, said method comprises a step of sending control signalling and/or data signalling to a crushing circuit and/or to a grinding circuit.

Furthermore, the objects of the invention are achieved by an arrangement for controlling a comminution process having a grinding circuit, which said arrangement comprises an imaging system, said imaging system measuring 3D reconstruction measurement data for three-dimensional reconstruction of in-coming ore to said grinding circuit;

a particle size analysis equipment measuring particle size data for calculation of the particle size characteristic value of outgoing ore from said grinding circuit;

an ore characteristics data calculation block, said ore characteristics data calculation block receiving a particle size distribution profile of in-coming ore and a particle size characteristic value of the outgoing ore, said particle size distribution profile of incoming ore being calculated and/or reconstructed from said 3D reconstruction measurement data for three-dimensional reconstruction, and said particle size characteristic value of the outgoing ore being calculated based on said measured particle size data, said ore characteristics data calculation block calculating ore characteristics data based on said particle size distribution profile and said particle size characteristic value, said ore characteristics data identifying ore characteristics, such as e.g. the ore hardness; and a control block, said control block controlling the grinding circuit in said comminution process based on said calculated ore characteristics data.

Preferably, said grinding circuit comprises:

at least two groups of grinding mills arranged in series, each one of said at least two groups or grinding mills comprising an at least one grinding mill; and an at least one classification block, each one of said at least one classification block comprising an at least one classification sorter.

Preferably, said imaging system is placed in the vicinity of a conveyor, by which said conveyor said incoming ore is conveyed. Preferably, said imaging system comprises at least one imaging device. Further preferably, said imaging system comprises a structured light source, and a first imaging device of said at least one imaging device is placed in the angle of 15-60 degrees, preferably 30-40 degrees compared to the structured light source, which first imaging device acquires 3D reconstruction measurement data for three-dimensional reconstruction from said incoming ore conveyed by said conveyor.

Further preferably, said imaging system comprises a structured light source, and a second imaging device of the at least one imaging device is placed at the opposing side to said first imaging device, and in the angle of 15-60 degrees, preferably 30-40 degrees compared to the structured light source, which second imaging device acquires 3D reconstruction measurement data for three-dimensional reconstruction from said incoming ore conveyed by said conveyor.

Preferably, said at least one imaging device acquires 3D reconstruction measurement data for three-dimensional reconstruction from said in-coming ore as it is travelling on said conveyor. Alternatively, said at least one imaging device acquires 3D reconstruction measurement data for three-dimensional reconstruction from said incoming ore as it is exiting said conveyor.

Preferably, said particle size analysis equipment includes a laser diffraction measurement sensor. Alternatively, said particle size analysis equipment includes a precision position measurement sensor.

Preferably, said control block receives comminution process data for controlling said comminution process, said comminution process data including one or more of the following data: ore mass feed, density, water addition, ball addition, pebbles feed, grinding mill speed, grinding product size, grinding mill power draw, grinding mill torque, grinding mill bearing pressure and grinding mill charge.

Preferably, said arrangement comprises at least one calculation block, which at least one calculation block calculates said particle size distribution profile of incoming ore and/or said particle size characteristic value of the outgoing ore. Further preferably, said at least one calculation block calculates control value data for controlling a crushing circuit and/or for controlling a grinding circuit.

Preferably, said control block sends control signalling and/or data signalling to a crushing circuit and/or to a grinding circuit. Preferably, said arrangement further comprises a data storage block, into which data storage block at least some of the calculated process values, e.g. the ore characteristics data, are stored. Further preferably, at least some of the measured process values are stored to said data storage block.

Furthermore, the objects of the invention are achieved by an arrangement for controlling a comminution process having a grinding circuit, which said arrangement comprises an imaging system, said imaging system measuring 3D reconstruction measurement data for three-dimensional reconstruction of in-coming ore to said grinding circuit;

a particle size analysis equipment measuring particle size data for calculation of the particle size characteristic value of outgoing ore from said grinding circuit; and a control block, said control block receiving a particle size distribution profile of incoming ore and a particle size characteristic value of the out-going ore, said particle size distribution profile of incoming ore being calculated and/or reconstructed from said 3D reconstruction measurement data for three-dimensional reconstruction, and said particle size characteristic value of the outgoing ore being calculated based on said measured particle size data.

Preferably, said grinding circuit comprises:

at least two groups of grinding mills arranged in series, each one of said at least two groups or grinding mills comprising an at least one grinding mill; and an at least one classification block, each one of said at least one classification block comprising an at least one classification sorter.

Preferably, said imaging system is placed in the vicinity of a conveyor, by which said conveyor said incoming ore is conveyed. Preferably, said imaging system comprises at least one imaging device. Further preferably, said imaging system comprises a structured light source, and a first imaging device of said at least one imaging device is placed in the angle of 15-60 degrees, preferably 30-40 degrees compared to the structured light source, which first imaging device acquires 3D reconstruction measurement data for three-dimensional reconstruction from said incoming ore conveyed by said conveyor.

Further preferably, said imaging system comprises a structured light source, and a second imaging device of the at least one imaging device is placed at the opposing side to said first imaging device, and in the angle of 15-60 degrees, preferably 30-40 degrees compared to the structured light source, which second imaging device acquires 3D reconstruction measurement data for three-dimensional reconstruction from said incoming ore conveyed by said conveyor.

Preferably, said at least one imaging device acquires 3D reconstruction measurement data for three-dimensional reconstruction from said in-coming ore as it is travelling on said conveyor. Alternatively, said at least one imaging device acquires 3D reconstruction measurement data for three-dimensional reconstruction from said incoming ore as it is exiting said conveyor.

Preferably, said particle size analysis equipment includes a laser diffraction measurement sensor. Alternatively, said particle size analysis equipment includes a precision position measurement sensor.

Preferably, said control block receives comminution process data for controlling said comminution process, said comminution process data including one or more of the following data: ore mass feed, density, water addition, ball addition, pebbles feed, grinding mill speed, grinding product size, grinding mill power draw, grinding mill torque, grinding mill bearing pressure and grinding mill charge.

Preferably, said arrangement comprises at least one calculation block, which at least one calculation block calculates said particle size distribution profile of incoming ore and/or said particle size characteristic value of the outgoing ore. Further preferably, said at least one calculation block calculates control value data for controlling a crushing circuit and/or for controlling a grinding circuit.

Preferably, said control block sends control signalling and/or data signalling to a crushing circuit and/or to a grinding circuit. Preferably, said arrangement further comprises a data storage block, into which data storage block at least some of the calculated process values, e.g. the ore characteristics data, are stored. Further preferably, at least some of the measured process values are stored to said data storage block.

Figure 1:
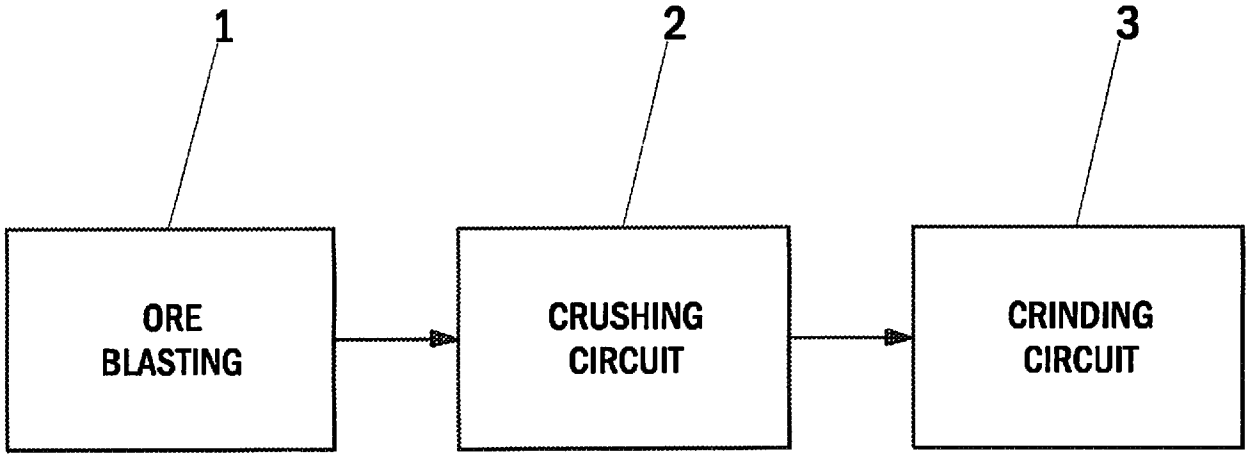
FIG. 1 shows a flow diagram of one example of a comminution process according to the present invention.

In the following, the invention will be described in greater detail by means of preferred embodiments with reference to the accompanying drawings of FIGS. 1 to 10.

DETAILED DESCRIPTION OF THE INVENTION

Ore comminution is part of mining and metallurgy processing. When processing material for the selective or collective recovery of valuable material components, the processes concerned are preceded by comminution processing i.e. mechanical crushing, grinding, or disintegration of the material in a manner to free valuable from worthless components. Comminution is particle size reduction of materials. Comminution is achieved by blasting, crushing and grinding. After comminution the components are then mutually isolated with the aid of known separation methods, this isolation being contingent on differences in color, shape, density or in differences in their respective surface active and magnetic properties, or other properties.

In comminution processing first ore or rock is excavated, broken down or removed by blasting. Blasting is the controlled use of explosives and other methods in mining, quarrying and civil engineering. Typically blasting produces top size particles of several decimeters or more and can to a degree control particle size distribution through a targeted powder factor.

Crushing is particle size reduction of ore or rock materials by using crushing devices i.e. crushers. Crushers e.g. jaw crushers, gyratory crushers or cone crushers are used to reduce the size, or change the form, of materials. In the crushing process the crushing devices hold material being crushed between two parallel or tangent solid surfaces of a stronger material and apply sufficient force to bring said surfaces together. Typically in a crushing process particles having a diameter up to 1000 mm are crushed to particles having a diameter of 5 mm or more.

Screening is typically carried out after crushing. In screening the ore is passed through a number of screens in a screening station. The screens in a screening station have openings or slots that continue to become smaller and smaller. Screening is used to produce different ore products based on an ore size range.

Grinding is particle size reduction of ore or rock materials in grinding mills such as tumbling, roller, or various types of fine grinding mills which can be arranged in either a vertical or horizontal orientation. In hard rock mining and industrial mineral operations the demands for rotating mineral and metallurgical processing equipment such as grinding mills are very high both in terms of grinding efficiency and energy consumption. Typically in a grinding process particles of a diameter as large as 150 mm or more are ground to particles having a diameter of sub-millimeter size or smaller, depending on whether a series of staged size reduction in different types of mills is employed, and depending on the type of mill and its operational setting. This conventional grinding of materials results in considerable wear on sacrificial liners installed inside the mechanical framework of the mill, due to the hardness and associated friction of the rock concerned, therewith also resulting in considerable costs for the provision of such grinding bodies.

Comminution processing equipment such as grinding mill is typically very large, having a diameter of several meters. Grinding mills may be trunnion-supported or shell-supported. Trunnion support is the most common way of supporting a mill in a mineral processing application, especially in very large grinding mills. Shell-supported grinding mills are more compact, occupy less floor space and require simpler foundations than comparable trunnion-supported grinding mills.

Coarse ore particle grinding mills are commonly either autogenous (AG) or semi-autogenous (SAG) grinding mills designed for grinding of primary crushed ore. Autogenous grinding mills are so-called due to the self-grinding of the ore. In an autogenous grinding mill a rotating drum throws ore in a cascading motion of the mill content (charge) which causes impact breakage by larger rocks and compressive grinding of particles below the charge surface. In autogenous grinding the actual material itself, i.e. the material to be ground, forms the grinding media.

Semi-autogenous grinding mills are similar to autogenous mills, but utilize grinding media e.g. steel grinding balls to aid in grinding. Impact and attrition between grinding balls and ore particles causes grinding of coarse particles into finer particles. Semi-autogenous grinding mills typically use a grinding ball charge of 8 to 21%, sometimes the total charge may be higher. Autogenous and semi-autogenous grinding mills are generally used as a primary or first stage grinding solution. They are primarily used at gold, copper and platinum mines with applications also in the lead, zinc, silver, alumina and nickel industries.

Ball mills are tumbling mills like SAG and AG mills, but are typically employed in a comparably fine grinding duty, often as a second stage behind SAG and AG mills. Like SAG mills, they use steel balls as grinding media, albeit of smaller diameter than SAG mills.

Autogenous and semi-autogenous grinding mills are characterized by their large diameter and short length as compared to ball mills, which are typically long with a smaller diameter. Tumbling mills are typically driven by ring gears, with a 360° fully enclosing guard. The inside of comminution equipment such as a tumbling mill is lined with sacrificial liners. Mill liner materials typically include steel, cast iron, solid rubber, rubber-steel composites or ceramics. Mill liners include lifters, e.g. lifter bars to lift the material inside the mill, where it then falls off the lifters onto the rest of the ore charge.

Comminution processing equipment that is provided with internal lifters is subject to changes in performance due to the change in liner shape caused by abrasive wear. For example, in autogenous grinding mills or semi-autogenous grinding mills the feed to the mill also acts as a grinding media, and changes in the feed have a strong effect on the grinding performance. Change in the feed properties, i.e. change in the feed parameters is a normal phenomenon that needs to be considered in controlling the comminution processing equipment.

Mineral deposits rarely have a homogenous structure or a homogenous mechanical strength. In regard to the feed parameters of a grinding process, the ore properties such as hardness, particle size, density and ore type also change constantly and this makes the control of the grinding process difficult, e.g. a constantly varying energy input is required.

The comminution process of a grinding mill is typically controlled on the basis of mill power draw as a grinding process parameter, yet power draw is sensitive to changes in feed parameters and mechanical properties of the grinding process and is often not a suitable indicator of grinding conditions inside the mill. Another grinding process parameter is the measurement of mill charge mass. However, mass measurement has its own problems in installation, calibration, and in measurement drift. Moreover, there may be intensive variations in the load density as well as significant variations in liner weight due to wear, in which case changes in the mass do not necessarily result from changes in fill level i.e. the grinding mill charge as percentages of mill volume. Fill level of the mill expressed as percentage of mill volume is a quantity that is very stable, descriptive and useful as an indicator in regards the state of the mill and therefore its efficiency.

It has been discovered that in an optimal grinding process control the measured grinding process parameters such as e.g. power draw, torque, bearing pressure, product size and mill load mass and also degree of fullness as percentages of mill volume would also require the knowledge of feed quantity and distribution in a grinding process.

As the grinding process control has a proper knowledge of both the measured grinding process parameters and the feed quantity of the grinding process it can carry out calculations for calculating of the degree of fullness in the mill as percentages of the mill volume and for determining grinding control parameters for controlling the grinding process such as e.g. mass feed, water addition, circulated pebbles, ball addition and speed.

The present invention relates to a method and arrangement for controlling of a comminution process, which provides a better controlled and more efficient comminution process when compared to the prior art solutions.

According to the present embodiment a three-dimensional reconstruction of the ore travelling on a conveyor belt is acquired by using a 3D camera (3D, three-dimensional) for scanning or photographing said ore travelling on a conveyor belt. There are several 3D technologies that can be used to obtain the 3D reconstruction. One approach is to use a system consisting of a line laser source and a digital imaging sensor, such as e.g. a CCD imaging sensor (CCD, Charge- Coupled Device) or a CMOS imaging sensor (CMOS, Complementary Metal-Oxide-Semiconductor).

FIG. 1 shows a flow diagram of one example of a comminution process according to the present invention. A comminution process according to the present invention comprises the process blocks for a crushing circuit 1, a screening process 2 and a grinding circuit 3. In a comminution process according to the present invention the crushing circuit process block 1 is carried out first. In the crushing circuit 1 the ore or rock material is crushed between two solid surfaces of a stronger material. In crushing the particle size of ore is substantially reduced. The crushing circuit 1 produces crushed ore for the screening process 2.

In screening process block 2 the ore is passed through a number of screens in a screening station. The screens in a screening station have openings or slots that continue to become smaller and smaller. In screening 2 different ore products based on an ore grade or an ore size range are produced.

After the screening process 2 the crushed and screened ore is forwarded to the grinding circuit process block 3. In the grinding circuit 3 the ore or rock material is ground in a grinding mill such as e.g. a tumbling mill, roller mill or a fine grinding mill. In the grinding circuit 3 the particle size of ore is reduced. Typically in a grinding circuit process block 3 particles of a diameter as large as 150 mm or more are ground to particles having a diameter of sub-millimeter size or smaller.

Figure 2:
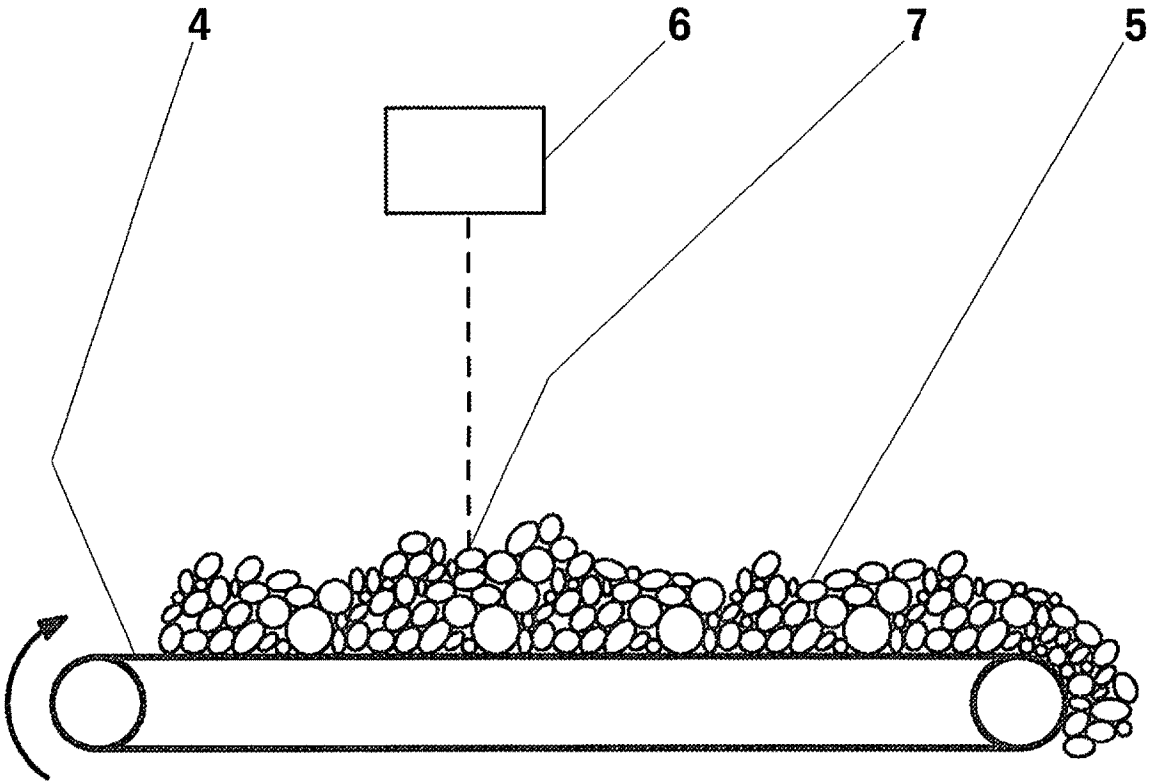
FIG. 2 shows a side view of one embodiment of an arrangement for monitoring the flow of ore travelling on a conveyor belt from the crusher to the grinding mill according to the present invention.

FIG. 2 shows a side view of one embodiment of an arrangement for monitoring the flow of ore travelling on a conveyor belt from the crusher to the grinding mill according to the present invention. The presented ore monitoring arrangement shows a conveyor belt 4 travelling clockwise from the crusher to the grinding mill. The conveyor belt 4 is first being fed ore 5 from the crusher, thereafter conveyor belt 4 conveys the ore 5 from left to right to the feed of the grinding mill.

In the presented ore monitoring arrangement of FIG. 2 there is a laser measurement unit 6 for measuring the surface height of ore travelling on a conveyor belt. The laser measurement unit 6 according to the present invention comprises a laser light source and a laser measurement receiver. The laser light source of the laser measurement unit 6 generates laser light towards the ore 5 travelling on a conveyor belt 4 from the crusher to the grinding mill. The generated laser light reflect back from the surface 7 of the ore 5 travelling on the conveyor belt 4.

Figure 3:
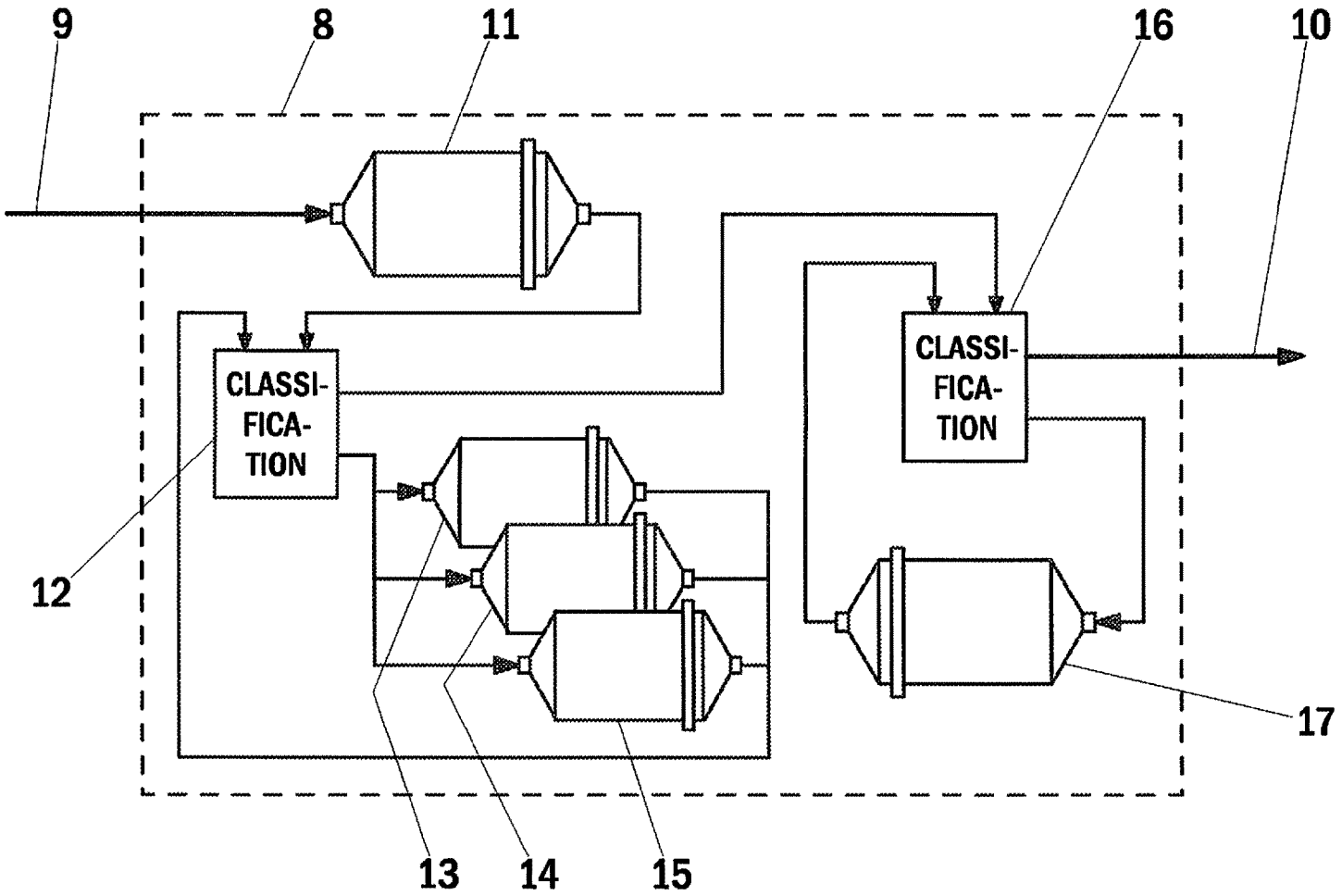
FIG. 3 shows a block diagram of one embodiment of a grinding circuit of a comminution process according to the present invention.

FIG. 3 shows a block diagram of one embodiment of a grinding circuit of a comminution process according to the present invention. The presented grinding circuit 8 according to the present invention comprises at least two groups of grinding mills 11, 13-15, 17 arranged in series, each one of said at least two groups or grinding mills 11, 13-15, 17 comprising an at least one grinding mill 11, 13-15, 17. In the grinding circuit 8 a first group of grinding mills 11 comprises one grinding mill 11, a second group of grinding mills 13-15 comprises three grinding mills 13-15, and a third group of grinding mills 17 comprises one grinding mill 17. In the grinding circuit 8 said three grinding mills 13-15 of the second group of grinding mills 13-15 are arranged parallel.

The grinding circuit 8 according to the present invention comprises an at least one classification block 12, 16, each one of said at least one classification block 12, 16 comprising an at least one classification sorter. In the grinding circuit 8 of a comminution process according to the present invention in-coming ore 9 is forwarded to said grinding circuit 8 for grinding. The in-coming ore 9 is first forwarded to the first group of grinding mills 11 of said grinding circuit 8 for grinding. From said first group of grinding mills 11 ground ore is forwarded to a first classification block 12. Thereafter, ore is classified by classification sorters of said first classification block 12. One part of the classified ore is forwarded from the first classification block 12 to a second classification block 16 and other parts of the classified ore is forwarded from the first classification block 12 to the second group of grinding mills 13-15 for grinding. The ground ore is returned back from said second group of grinding mills 13-15 to said first classification block 12. Furthermore, in an alternative embodiment of the present invention said at least one classification block 12, 16 may be integrated to said grinding circuit.

In the next phase, said part of the classified ore is forwarded from said first classification block 12 to said second classification block 16 is classified by classification sorter/sorters of said second classification block 16. One part of the classified ore is forwarded from the second classification block 16 to the third group of grinding mills 17 for grinding. The ground ore is returned back from said second group of grinding mills 17 to said second classification block 16. Another part of the ore classified as outgoing ore 10 by said second classification block 16 and said outgoing ore 10 is the forwarded out from said second classification block 16 and forwarded out from said grinding circuit 8 of a comminution process according to the present invention.

Figure 4:
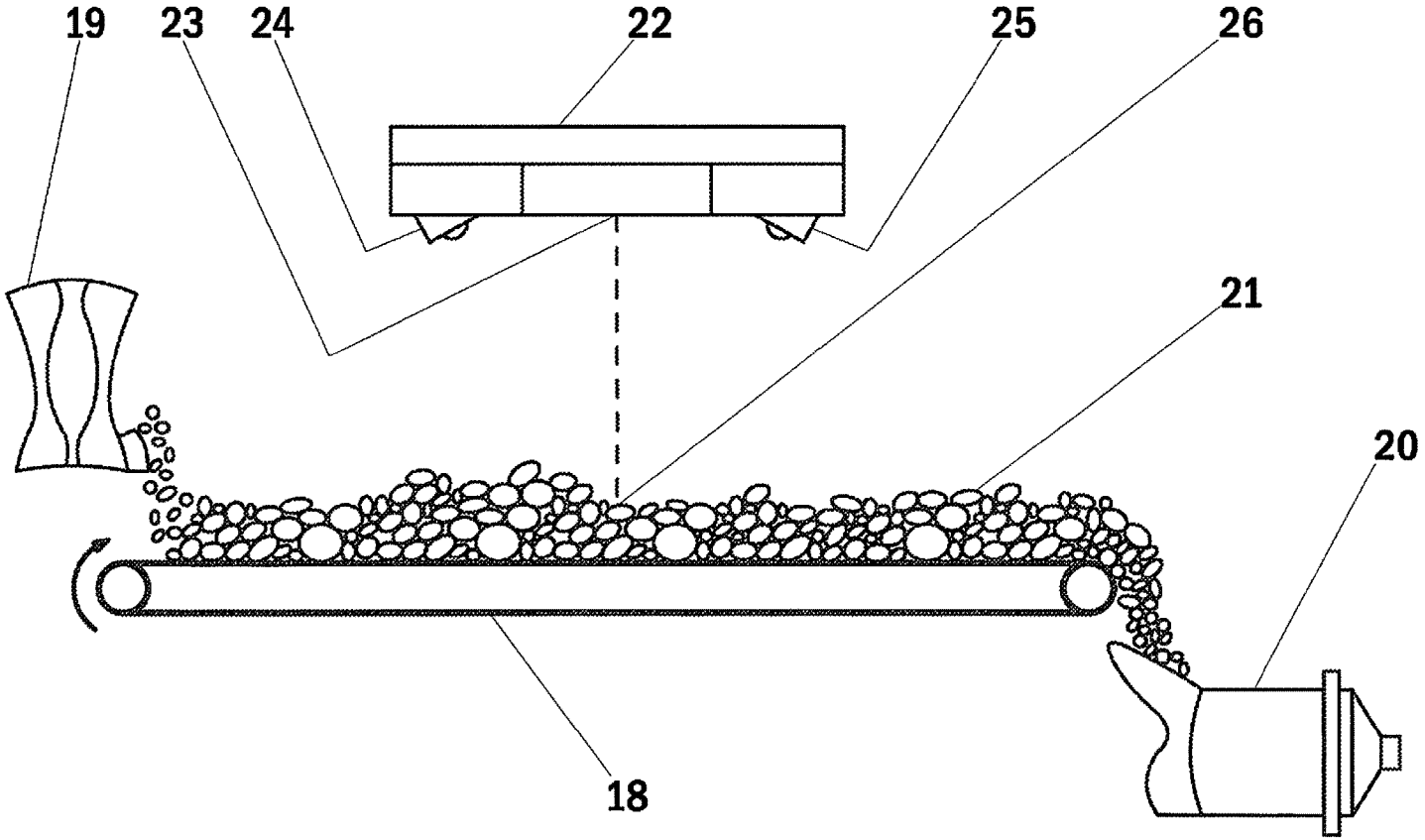
FIG. 4 shows a side view of one embodiment of an arrangement for measuring of a three-dimensional reconstruction of the ore travelling on a conveyor belt from the crusher to the grinding mill of a grinding circuit according to the present invention.

FIG. 4 shows a side view of one embodiment of an arrangement for measuring of a three-dimensional reconstruction of the ore travelling on a conveyor belt from the crusher to the grinding mill of a grinding circuit according to the present invention. The presented three-dimensional reconstruction measuring arrangement shows a conveyor 18, e.g. a conveyor belt 18, travelling clockwise from a crushing circuit 19 to the grinding mill of grinding circuit 20.

In the presented embodiment of the three-dimensional reconstruction measuring arrangement according to the present invention the conveyor belt 18 is first being fed ore 21 from the crushing circuit 19, thereafter conveyor belt 18 conveys the ore 21 from left to right to the feed of the grinding mill of grinding circuit 20. The presented three-dimensional reconstruction measuring arrangement also comprises an imaging system 22, e.g. a three-dimensional imaging system 22, placed above the conveyor belt 18, said three-dimensional imaging system 22 comprising a structured light source, e.g. a line laser source 23, and at least one imaging device 24, 25.

The line laser source 23 of the three-dimensional imaging system 22 generates a laser line and draws a coherent light line on the ore 21 travelling on the conveyor belt 18 from the crushing circuit 19 to the grinding mill of grinding circuit 20. The generated laser light reflects back from the surface 26 of the ore 21 travelling on the conveyor belt 18.

In the presented embodiment of the three-dimensional surface profile measuring arrangement according to the present invention a first imaging device 24, e.g. a CCD imaging sensor 24 or a CMOS imaging sensor 24, of the at least one imaging device 24, 25 is placed in the angle of 0-150 degrees, preferably 15-60 degrees, more preferably 30-40 degrees compared to the line laser source 23. The first imaging device 24 of the at least one imaging device 24, 25 is constantly acquiring measurement data for three-dimensional reconstruction from the ore 21 travelling on the conveyor belt 18. The reflected laser line reflected back from the surface 26 of the ore 21 and is detected in the three-dimensional reconstructions taken by said first imaging device 24. For example in one three-dimensional reconstruction representing one cross-section of said ore 21 travelling on the conveyor belt 18, the location of the laser line may be identified by machine vision algorithms and transformed to the real height of the ore bed for said cross-section.

As the conveyor belt 18 is moving, and the speed of the conveyor belt 18 is known, consequently an enhanced volumetric flow and a three-dimensional reconstruction of the ore 21 travelling on the conveyor belt 18 is obtained. The 3D profile image obtained using the presented principle i.e. triangulation principle, will inherently include also the shadow areas in the 3D reconstruction that cannot be detected by the camera. To reduce this effect two cameras can be used.

In the presented embodiment of the three-dimensional surface profile measuring arrangement according to the present invention there is also a second imaging device 25, e.g. a CCD imaging sensor 25 or a CMOS imaging sensor 25, of the at least one imaging device 24, 25 is placed at the opposing side to said first imaging device 24, and in the angle of 0-150 degrees, preferably 15-60 degrees, more preferably 30-40 degrees compared to the line laser source 23. Also the second imaging device 25 of the at least one imaging device 24, 25 is constantly acquiring measurement data for three-dimensional reconstruction from the ore 21 travelling on the conveyor belt 18. The reflected laser line reflected back from the surface 26 of the ore 21 and is detected in the three-dimensional reconstructions taken by said second imaging device 25.

In the present embodiment the imaging devices 24, 25 may be any types of regular imaging devices 24, 25, e.g. based on digital imaging technology. Digital imaging technology is a technology utilizing sensors, e.g. containing grids of pixels, and is widely used in professional, medical, and scientific applications where high-quality measurement data is required such as in digital cameras, in optical scanners, in video cameras and in light-sensing devices.

Furthermore, in the present embodiment the ore is travelling on a conveyor leading directly to a grinding mill. Also in the present embodiment the imaging devices are positioned for acquiring measurement data for three-dimensional reconstruction from the ore as it is travelling on a conveyor leading to a grinding mill. However, in an alternative embodiment of the present invention, said comminution process may have several conveyors, screening stations and storage bins. Likewise, in an alternative embodiment of the present invention, said at least one imaging device acquires measurement data for three-dimensional reconstruction from said ore as it is travelling on any conveyor in a comminution process or exiting any conveyor in a comminution process.

Figure 5:
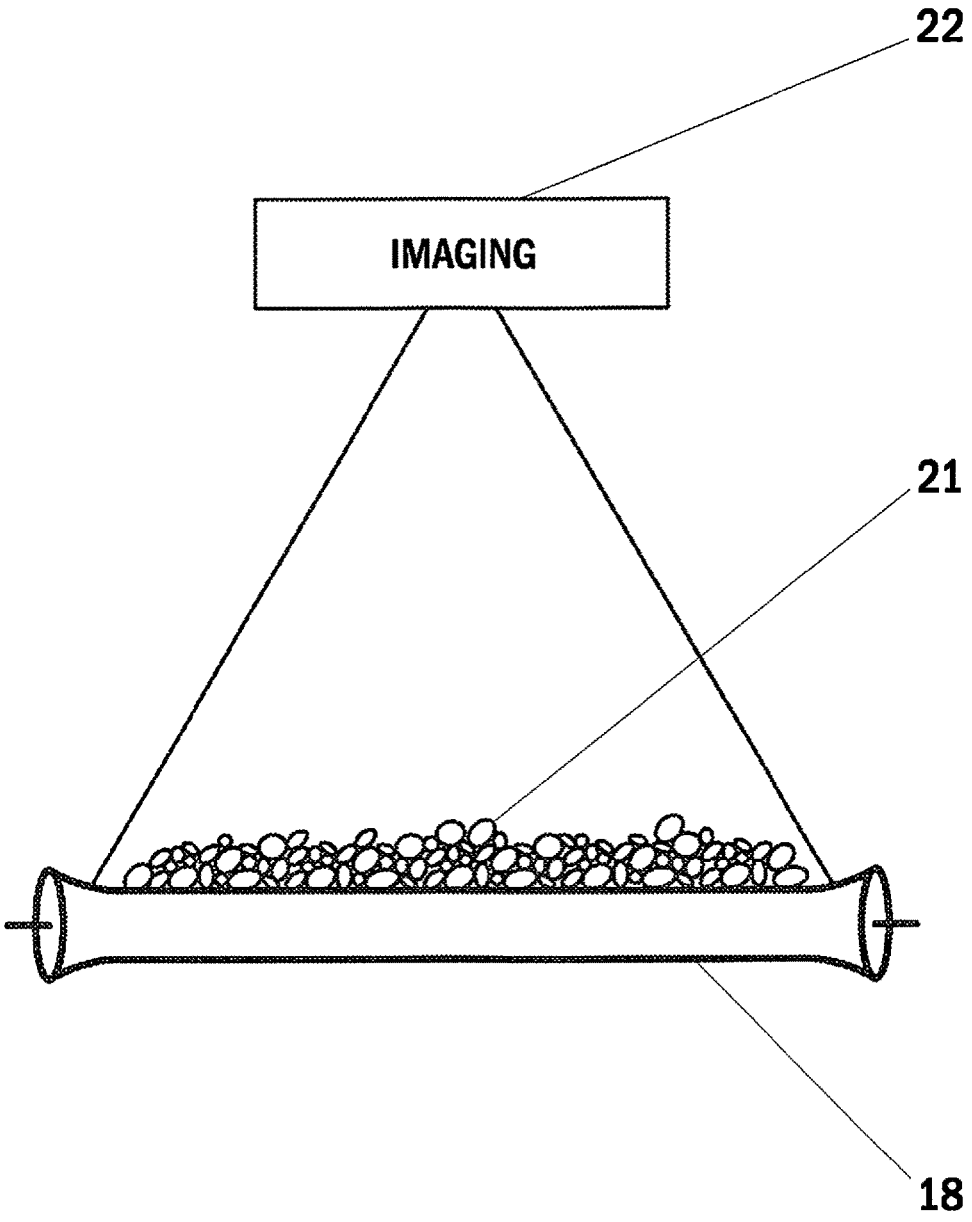
FIG. 5 shows a backside view of a conveyor belt and a three-dimensional imaging system of one embodiment of an arrangement for measuring of a three-dimensional reconstruction of the ore travelling on a conveyor belt from the crusher to the grinding mill of grinding circuit according to the present invention.

FIG. 5 shows a backside view of a conveyor belt and a three-dimensional imaging system of one embodiment of an arrangement for measuring of a three-dimensional reconstruction of the ore travelling on a conveyor belt from the crusher to the grinding mill of grinding circuit according to the present invention. In the presented embodiment of the three-dimensional reconstruction measuring arrangement according to the present invention the conveyor belt 18 conveys the ore 21 from the crushing circuit to the feed of the grinding mill. The presented three-dimensional reconstruction measuring arrangement comprises an imaging system 22, e.g. a three-dimensional imaging system 22 placed above the conveyor belt 18, said three-dimensional imaging system 22 comprising a structured light source, e.g. a line laser source, and at least one imaging device. The line laser source of the three-dimensional imaging system 22 generates a laser line and draws a coherent light line on the ore 21 travelling on the conveyor belt 18. The generated laser light reflects back from the surface of the ore 21 travelling on the conveyor belt 18.

In the presented embodiment of the three-dimensional surface profile measuring arrangement according to the present invention a first imaging device of the at least one imaging device is placed in the angle of 0-150 degrees, preferably 15-60 degrees, more preferably 30-40 degrees compared to the line laser source of the three-dimensional imaging system 22. The first imaging device of the at least one imaging device is constantly acquiring measurement data for three-dimensional reconstruction from the ore 21 travelling on the conveyor belt 18. The reflected laser line reflected back from the surface of the ore 21 and is detected in the digital images taken by said first imaging device. As the conveyor belt 18 is moving, and the speed of the conveyor belt 18 is known, consequently an enhanced volumetric flow and a three-dimensional reconstruction of the ore 21 travelling on the conveyor belt 18 is obtained.

Furthermore, in the presented embodiment of the three-dimensional surface profile measuring arrangement according to the present invention there may also be a second imaging device of the at least one imaging device, which second imaging device is placed at the opposing side to said first imaging device, and in the angle of 0-150 degrees, preferably 15-60 degrees, more preferably 30-40 degrees compared to the line laser source of the three-dimensional imaging system 22.

Figure 6:
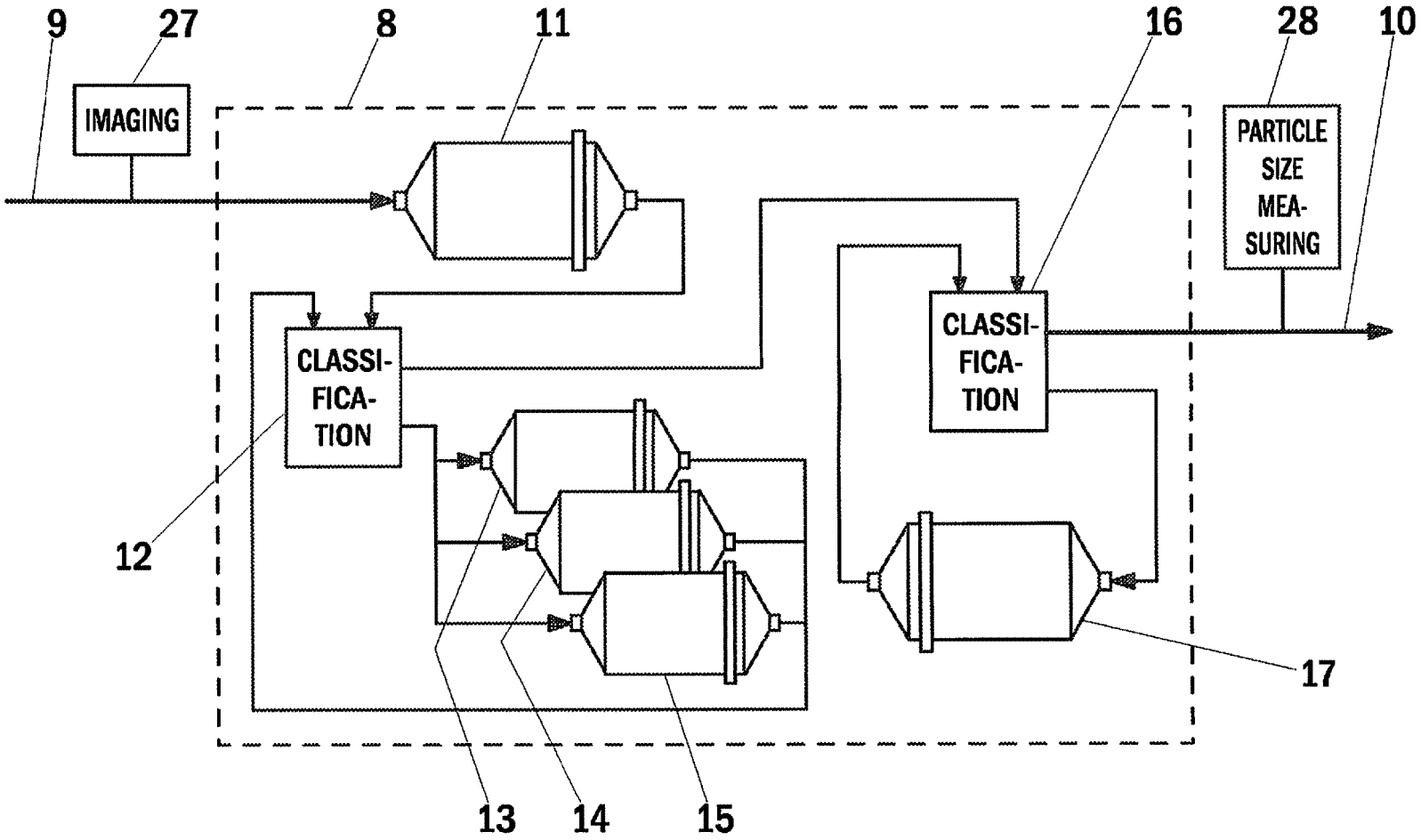
FIG. 6 shows a block diagram of another embodiment of a grinding circuit of a comminution process according to the present invention.

FIG. 6 shows a block diagram of another embodiment of a grinding circuit of a comminution process according to the present invention. The presented another embodiment of a grinding circuit 8 comprises at least two groups of grinding mills 11, 13-15, 17 arranged in series, each one of said at least two groups or grinding mills 11, 13-15, 17 comprising an at least one grinding mill 11, 13-15, 17. In the present embodiment a first group of grinding mills 11 comprises one grinding mill 11, a second group of grinding mills 13-15 comprises three grinding mills 13-15, and a third group of grinding mills 17 comprises one grinding mill 17. In the present embodiment said three grinding mills 13-15 of the second group of grinding mills 13-15 are arranged parallel.

The presented another embodiment of a grinding circuit 8 comprises an at least one classification block 12, 16, each one of said at least one classification block 12, 16 comprising an at least one classification sorter. In the presented embodiment of a comminution process according to the present invention incoming ore 9 is forwarded to said grinding circuit 8 for grinding. The in-coming ore 9 is first forwarded to the first group of grinding mills 11 of said grinding circuit 8 for grinding. From said first group of grinding mills 11 ground ore is forwarded to a first classification block 12. Thereafter, ore is classified by classification sorters of said first classification block 12. One part of the classified ore is forwarded from the first classification block 12 to a second classification block 16 and other parts of the classified ore is forwarded from the first classification block 12 to the second group of grinding mills 13-15 for grinding. The ground ore is returned back from said second group of grinding mills 13-15 to said first classification block 12.

In the next phase, said part of the classified ore is forwarded from said first classification block 12 to said second classification block 16 is classified by classification sorter/sorters of said second classification block 16. One part of the classified ore is forwarded from the second classification block 16 to the third group of grinding mills 17 for grinding. The ground ore is returned back from said second group of grinding mills 17 to said second classification block 16. Another part of the ore classified as outgoing ore 10 by said second classification block 16 and said outgoing ore 10 is the forwarded out from said second classification block 16 and forwarded out from said grinding circuit 8 of the presented embodiment of a comminution process according to the present invention.

In the presented another embodiment of an arrangement for controlling a comminution process according to the present invention said arrangement comprises an imaging system 27 and a particle size analysis equipment 28. The imaging system 27 measures measurement data for three-dimensional reconstruction of incoming ore 9 to said grinding circuit 8. The particle size analysis equipment 28 measures particle size data for calculation of the particle size characteristic value of outgoing ore 10 from said grinding circuit 8.

In the presented another embodiment of an arrangement for controlling a comminution process according to the present invention the ore characteristics, such as e.g. the ore hardness, are identified on continuous basis to allow effective control and optimization of grinding process. The ore characteristics, such as e.g. the ore hardness, are calculated over the whole grinding circuit 8 that is in continuous operation.

Figure 7:
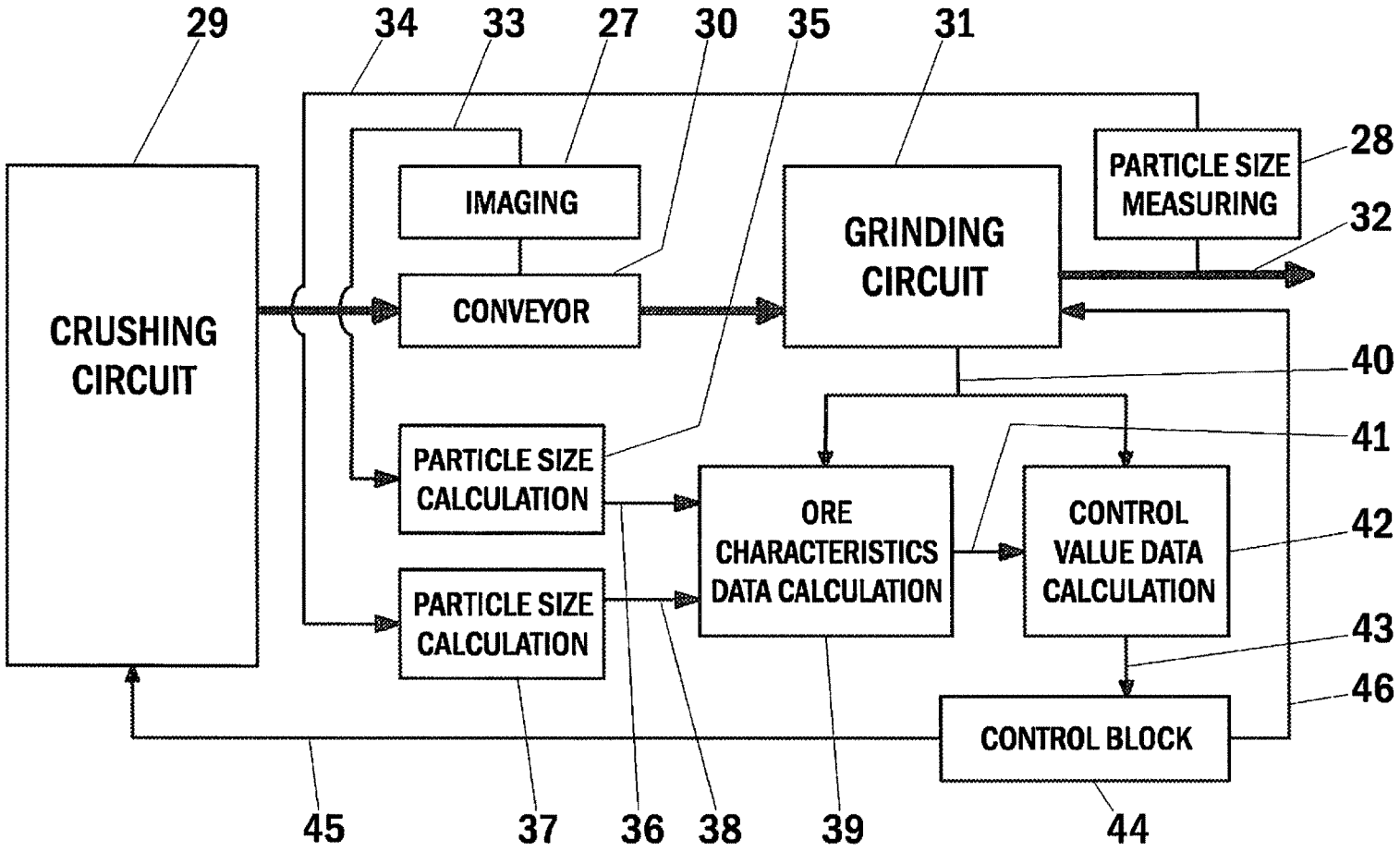
FIG. 7 shows a schematic diagram of one embodiment of an arrangement for controlling of a comminution process according to the present invention.

FIG. 7 shows a schematic diagram of one embodiment of an arrangement for controlling of a comminution process according to the present invention. The presented embodiment of an arrangement for controlling of a comminution process according to the present invention comprises a crushing circuit 29, a grinding circuit 31 and a conveyor 30 conveying ore from the crushing circuit 29 towards the grinding circuit 31.

The controlling arrangement according to the presented embodiment also comprises an imaging system 27 for measuring 3D reconstruction measurement data 33 from ore before entering said grinding circuit 31. The imaging system 27 monitors the flow of ore before it enters said grinding circuit 31 of said comminution process. The imaging system 27 of the presented embodiment is placed in the vicinity of said conveyor 30. In the presented embodiment said imaging system 27 measures 3D reconstruction measurement data 33 from ore conveyed by said conveyor 30 and forwards said measured 3D reconstruction measurement data 33 to a first particle size calculation block 35.

In the controlling arrangement according to the presented embodiment said first particle size calculation block 35 then obtains a three-dimensional reconstruction of the ore travelling on the conveyor 30 based on the received measured 3D reconstruction measurement data 33. Thereafter, said first particle size calculation block 35 calculates a particle size distribution profile 36 of incoming ore based on said three-dimensional reconstruction of incoming ore. Thereafter, said first particle size calculation block 35 forwards said particle size distribution profile 36 of the incoming ore and/or said measured 3D reconstruction measurement data 33 and/or said three-dimensional reconstruction to an ore characteristics data calculation block 39.

The controlling arrangement according to the presented embodiment also comprises a particle size analysis equipment 28 for measuring particle size data 34 from outgoing ore 32 after exiting said grinding circuit 31. In the presented embodiment said particle size analysis equipment 28 measures particle size data 34 from said from outgoing ore 32 and forwards said measured particle size data 34 to a second particle size calculation block 37. In the controlling arrangement according to the presented embodiment said particle size analysis equipment 28 may include a laser diffraction measurement sensor or a precision position measurement sensor.

In the controlling arrangement according to the presented embodiment said second particle size calculation block 37 then calculates a particle size characteristic value 38 of the outgoing ore 32 based on the received measured particle size data 34. Thereafter, said second particle size calculation block 37 forwards said measured particle size data 34 including said particle size characteristic value 38 of the outgoing ore 32 to said ore characteristics data calculation block 39.

In said ore characteristics data calculation block 39 ore characteristics data 41 is calculated. The ore characteristics data calculation block 39 also receives comminution process data 40 from said grinding circuit 31. In said ore characteristics data calculation block 39 said ore characteristics data 41 are calculated based on said measured 3D reconstruction measurement data 33 and/or said particle size distribution profile 36 and/or said three-dimensional reconstruction of the incoming ore and/or said measured particle size data 34 and/or said particle size characteristic value 38 of the outgoing ore 32 and/or said received comminution process data 40. Furthermore, in said ore characteristics data calculation block 39 there is calculated one or more distinct property values for one or more rock size variables, said one or more distinct property values being calculated based on said measured 3D reconstruction measurement data 33 and/or said particle size distribution profile 36 and/or said three-dimensional reconstruction of the incoming ore and/or said measured particle size data 34 and/or said particle size characteristic value 38 of the out-going ore 32.

The ore characteristics data calculation block 39 forwards said ore characteristics data 41 and said one or more distinct property values towards a control block 44 of the controlling arrangement according to the presented embodiment. The one or more rock size variables may include one or more of the following: a volumetric flow of a certain specified largest percentage of particies, a volumetric flow of a certain specified smallest percentage of particles, a volumetric flow of a certain specified mid-size range of particles, a particle count of a certain specified largest percentage of particles, a particle count of a certain specified smallest percentage of particles, a particle count of a certain specified pebble size range of particles. Pebble size range is the correct particle size range for a given configuration to be used as a grinding media in the grinding mill.

The controlling arrangement according to the presented embodiment also comprises a separate control value data calculation block 42 for calculation of control value data 43 and for forwarding said calculated control value data 43 to said control block 44. The control value data calculation block 42 according to the presented embodiment receives said ore characteristics data 41 and/or said one or more distinct property values from said ore characteristics data calculation block 39. The control value data calculation block 42 also receives comminution process data 40 from said grinding circuit 31. The comminution process data 40 may include one or more of the following data: mass feed, water addition, ball addition, pebbles feed, grinding mill speed, hardness, density, ore specific gravity, elemental analysis, ore grade, grinding product size, grinding mill power draw, grinding mill torque, grinding mill bearing pressure and grinding mill charge.

In the controlling arrangement according to the presented embodiment said control value data calculation block 42 calculates control value data 43 based on the received data and forwards said calculated control value data 43 to said control block 44. The control value data calculation block 42 may also forward the received ore characteristics data 41 and/or the received one or more distinct property values for one or more rock size variables and/or the received comminution process data 40 along with said calculated control value data 43 to said control block 44.

The control block 44 according to the presented embodiment receives said calculated control value data 43 and may also receive said ore characteristics data 41 and/or said one or more distinct property values and/or said comminution process data 40 along with said calculated control value data 43. The control block 44 controls the crushing circuit 29 and/or the grinding circuit 31 by e.g. by sending control signalling 45, 46 and/or data signalling 45, 46 to the crushing circuit 29 and/or to the grinding circuit 31. In an alternative embodiment, said control value data calculation block 42 may be integrated into said control block 44. The control block 44 according to the presented embodiment may control e.g. grinding mill speed and/or mass feed and/or water addition and/or ball addition and/or pebbles feed to a grinding circuit 31 of said comminution process based on said received ore characteristics data 41 and/or the received one or more distinct property values for one or more rock size variables.

Figure 8:
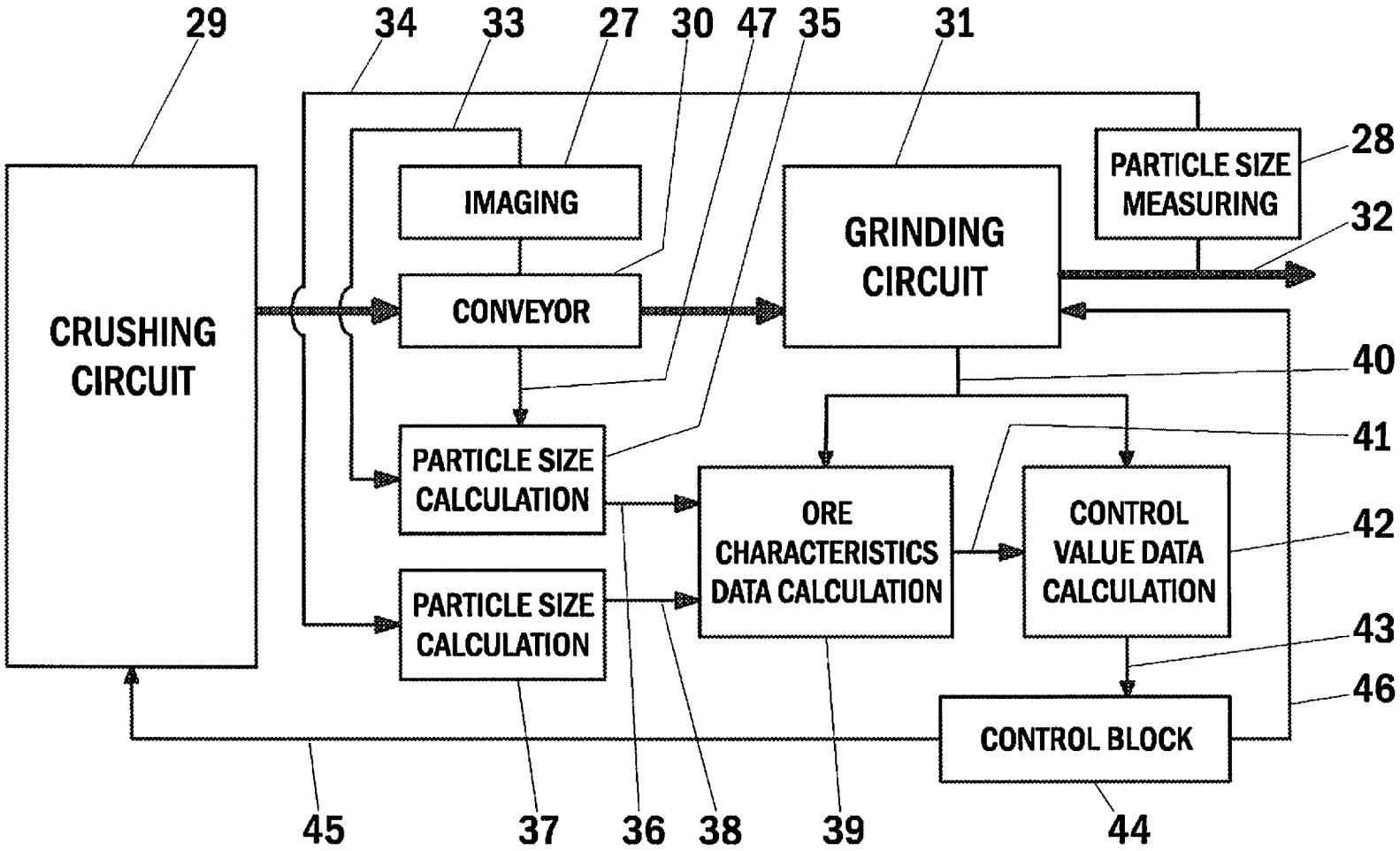
FIG. 8 shows a schematic diagram of another embodiment of an arrangement for controlling of a comminution process according to the present invention.

FIG. 8 shows a schematic diagram of another embodiment of an arrangement for controlling of a comminution process according to the present invention. The presented another embodiment of an arrangement for controlling of a comminution process according to the present invention comprises a crushing circuit 29, a grinding circuit 31 and a conveyor 30 conveying ore from the crushing circuit 29 towards the grinding circuit 31.

The controlling arrangement according to the presented another embodiment also comprises an imaging system 27 for measuring 3D reconstruction measurement data 33 from ore before entering said grinding circuit 31. The imaging system 27 monitors the flow of ore before it enters said grinding circuit 31 of said comminution process. The imaging system 27 of the presented another embodiment is placed in the vicinity of said conveyor 30. In the presented another embodiment said imaging system 27 measures 3D reconstruction measurement data 33 from ore conveyed by said conveyor 30 and forwards said measured 3D reconstruction measurement data 33 to a first particle size calculation block 35.

In the controlling arrangement according to the presented another embodiment said first particle size calculation block 35 also receives conveyor speed 47 from the conveyor 30. The first particle size calculation block 35 then consequently obtains a three-dimensional reconstruction of the ore travelling on the conveyor 30 based on the received measured 3D reconstruction measurement data 33 and the received conveyor speed 47. Thereafter, said first particle size calculation block 35 calculates a particle size distribution profile 36 of incoming ore based on said three-dimensional reconstruction of in-coming ore. Thereafter, said first particle size calculation block 35 forwards said particle size distribution profile 36 of the incoming ore and/or said measured 3D reconstruction measurement data 33 and/or said three-dimensional reconstruction to an ore characteristics data calculation block 39.

The controlling arrangement according to the presented another embodiment also comprises a particle size analysis equipment 28 for measuring particle size data 34 from outgoing ore 32 after exiting said grinding circuit 31. In the presented another embodiment said particle size analysis equipment 28 measures particle size data 34 from said from outgoing ore 32 and forwards said measured particle size data 34 to a second particle size calculation block 37. In the controlling arrangement according to the presented another embodiment said particle size analysis equipment 28 may include a laser diffraction measurement sensor or a precision position measurement sensor.

In the controlling arrangement according to the presented another embodiment said second particle size calculation block 37 then calculates a particle size characteristic value 38 of the outgoing ore 32 based on the received measured particle size data 34. Thereafter, said second particle size calculation block 37 forwards said measured particle size data 34 including said particle size characteristic value 38 of the outgoing ore 32 to said ore characteristics data calculation block 39.

In said ore characteristics data calculation block 39 ore characteristics data 41 is calculated. The ore characteristics data calculation block 39 also receives comminution process data 40 from said grinding circuit 31. In said ore characteristics data calculation block 39 said ore characteristics data 41 are calculated based on said measured 3D reconstruction measurement data 33 and/or said particle size distribution profile 36 and/or said three-dimensional reconstruction of the incoming ore and/or said measured particle size data 34 and/or said particle size characteristic value 38 of the outgoing ore 32 and/or said received comminution process data 40. Furthermore, in said ore characteristics data calculation block 39 there is calculated one or more distinct property values for one or more rock size variables, said one or more distinct property values being calculated based on said measured 3D reconstruction measurement data 33 and/or said particle size distribution profile 36 and/or said three-dimensional reconstruction of the incoming ore and/or said measured particle size data 34 and/or said particle size characteristic value 38 of the out-going ore 32.

The ore characteristics data calculation block 39 forwards said ore characteristics data 41 and said one or more distinct property values towards a control block 44 of the controlling arrangement according to the presented another embodiment. The one or more rock size variables may include one or more of the following: a volumetric flow of a certain specified largest percentage of particles, a volumetric flow of a certain specified smallest percentage of particles, a volumetric flow of a certain specified mid-size range of particles, a particle count of a certain specified largest percentage of particles, a particle count of a certain specified smallest percentage of particles, a particle count of a certain specified pebble size range of particles.

The controlling arrangement according to the presented another embodiment also comprises a separate control value data calculation block 42 for calculation of control value data 43 and for forwarding said calculated control value data 43 to said control block 44. The control value data calculation block 42 according to the presented another embodiment receives said ore characteristics data 41 and/or said one or more distinct property values from said ore characteristics data calculation block 39. The control value data calculation block 42 also receives comminution process data 40 from said grinding circuit 31. The comminution process data 40 may include one or more of the following data: mass feed, water addition, ball addition, pebbles feed, grinding mill speed, hardness, density, ore specific gravity, elemental analysis, ore grade, grinding product size, grinding mill power draw, grinding mill torque, grinding mill bearing pressure and grinding mill charge.

In the controlling arrangement according to the presented another embodiment said control value data calculation block 42 calculates control value data 43 based on the received data and forwards said calculated control value data 43 to said control block 44. The control value data calculation block 42 may also forward the received ore characteristics data 41 and/or the received one or more distinct property values for one or more rock size variables and/or the received comminution process data 40 along with said calculated control value data 43 to said control block 44.

The control block 44 according to the presented another embodiment receives said calculated control value data 43 and may also receive said ore characteristics data 41 and/or said one or more distinct property values and/or said comminution process data 40 along with said calculated control value data 43. The control block 44 controls the crushing circuit 29 and/or the grinding circuit 31 by e.g. by sending control signalling 45, 46 and/or data signailing 45, 46 to the crushing circuit 29 and/or to the grinding circuit 31. In an alternative embodiment, said control value data calculation block 42 may be integrated into said control block 44. The control block 44 according to the presented another embodiment may control e.g. grinding mill speed and/or mass feed and/or water addition and/or ball addition and/or pebbles feed to a grinding circuit 31 of said comminution process based on said received ore characteristics data 41 and/or the received one or more distinct property values for one or more rock size variables.

Figure 9:
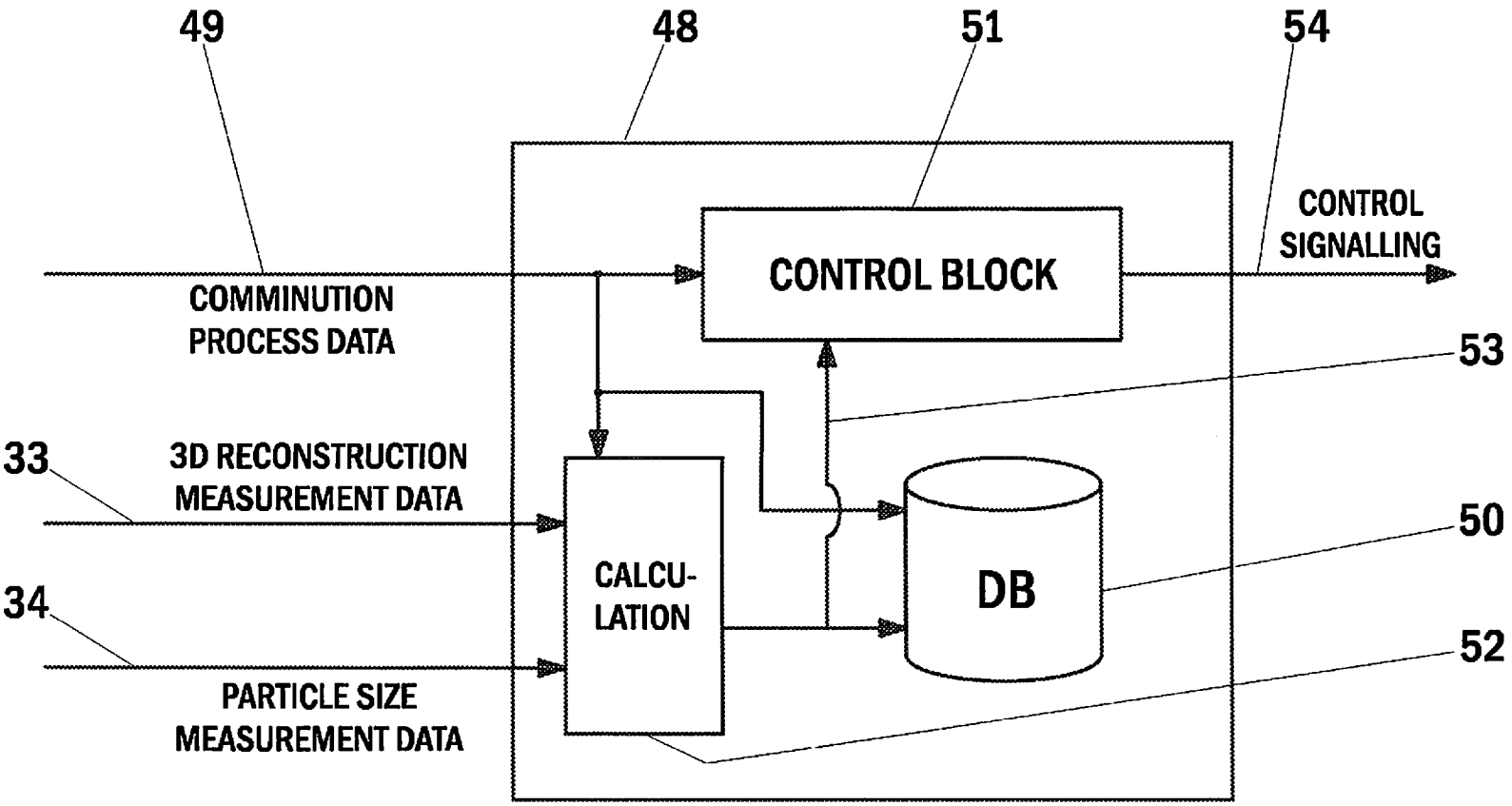
FIG. 9 shows a schematic diagram of one embodiment of a comminution control unit of an arrangement for controlling of a comminution process according to the present invention.

FIG. 9 shows a schematic diagram of one embodiment of a comminution control unit of an arrangement for controlling of a comminution process according to the present invention. The comminution control unit 48 according to the presented embodiment receives comminution process data 49 from the comminution process. The comminution control unit 48 according to the presented embodiment comprises a control block 51 receiving said comminution process data 49 and a data storage block 50 receiving and storing said comminution process data 49.

Furthermore, the comminution control unit 48 according to the presented embodiment comprises a calculation block 52. The calculation block 52 receives measured 3D reconstruction measurement data 33 of the in-coming ore from an imaging system of the controlling arrangement according to the present invention. The calculation block 52 also receives measured particle size data 34 of the outgoing ore from a particle size analysis equipment of the controlling arrangement according to the present invention.

The calculation block 52 calculates calculation data 53, said calculation 53 data comprising the three-dimensional reconstruction of the ore and/or the received ore characteristics data and/or the received one or more distinct property values for one or more rock size variables and/or the control value data. The calculation block 52 forwards said calculation data 53 to said control block 51 and to said data storage block 50. The control block 51 of the comminution control unit 48 according to the presented embodiment controls the comminution process by sending control signalling 54 to the different comminution process blocks, e.g. to the crushing circuit and/or to the grinding circuit.

Figure 10:
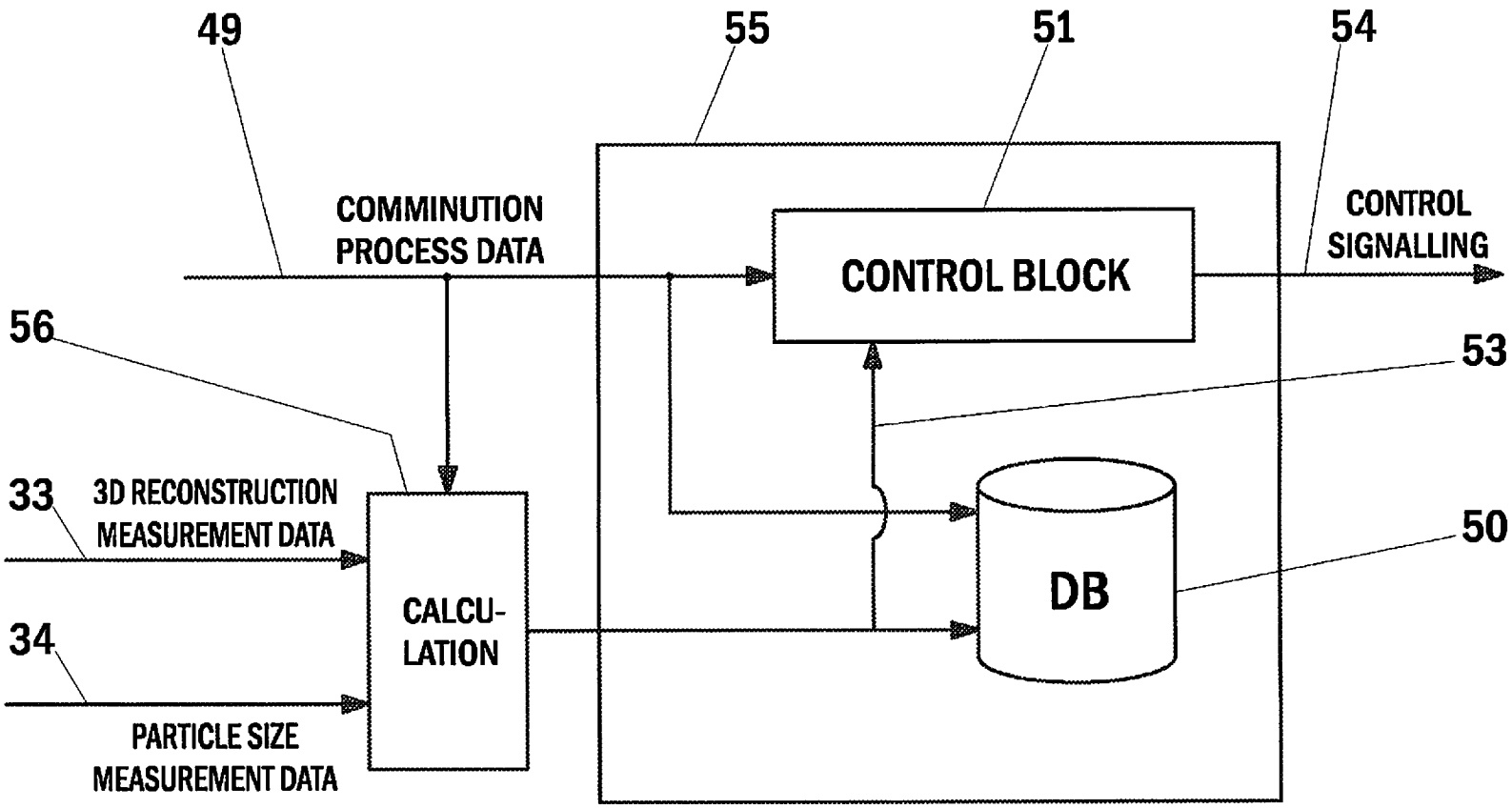
FIG. 10 shows a schematic diagram of another embodiment of a comminution control unit of an arrangement for controlling of a comminution process according to the present invention.

FIG. 10 shows a schematic diagram of another embodiment of a comminution control unit of an arrangement for controlling of a comminution process according to the present invention. The comminution control unit 55 according to the presented another embodiment receives comminution process data 49 from the comminution process. The comminution control unit 55 according to the presented another embodiment comprises a control block 51 receiving said comminution process data 49 and a data storage block 50 receiving and storing said comminution process data 49.

Furthermore, the presented arrangement for controlling of a comminution process according to the present invention comprises a calculation block 56. The calculation block 56 receives measured 3D reconstruction measurement data 33 of the incoming ore from an imaging system of the controlling arrangement according to the present invention. The calculation block 52 also receives measured particle size data 34 of the outgoing ore from a particle size analysis equipment of the controlling arrangement according to the present invention.

The calculation block 56 calculates calculation data 53, said calculation 53 data comprising the three-dimensional reconstruction of the ore and/or the received ore characteristics data and/or the received one or more distinct property values for one or more rock size variables and/or the control value data. The calculation block 56 forwards said calculation data 53 to said control block 51 and to said data storage block 50 of said comminution control unit 55 according to the presented another embodiment. The control block 51 of the comminution control unit 55 according to the presented another embodiment controls the comminution process by sending control signalling 54 to the different comminution process blocks, e.g. to the crushing circuit and/or to the grinding circuit.

The arrangement for controlling of a comminution process according to the present invention may control the crushing circuit by producing crushing control signalling for controlling the crushing process control parameters, that is, by e.g. controlling the screen control and/or the vibrating feeder control so that the desired crushing process output i.e. out coming rock size distribution is sought.

The arrangement for controlling of a comminution process according to the present invention may control the grinding circuit by producing grinding control signalling for controlling the grinding process control parameters so that the desired grinding process output is sought.

In a typical grinding circuit control it is typical to keep the mill charge or the filling of the grinding mill at the constant level by controlling the feed to the mill. As an indication of the filling, the mill power draw and mill bearing pressures are often used. This typical approach works relatively well in case the ore hardness, the density, and the size distribution of the feed are constant. Unfortunately all of these variables are unknown and changing continuously. The solution according to the present invention brings a relief to this problem.

Grinding of ore for downstream processing requires a high amount of energy per produced ton of ore. In the method and arrangement for controlling a comminution process according to the present invention a substantial savings in the required energy is reached. Furthermore, due to the efficient grinding process according to the present invention there is a significant positive impact on liberation of minerals and also on the metallurgical performance of the downstream mineral separation process.

In the method and arrangement for controlling a comminution process according to the present invention the ore characteristics, such as e.g. the ore hardness, are identified on continuous basis to allow effective control and optimization of grinding process. The ore characteristics, such as e.g. the ore hardness, are calculated over the whole grinding circuit that is in continuous operation. With the obtained ore characteristics data according to the present invention the automated control of the grinding circuit is optimized on continuous basis. This in turn brings about more optimized use of energy and the recovery of valuable minerals in the comminution process.

With the obtained ore characteristics data according to the present invention it is possible to assess these disturbances in the grinding circuit control and take the necessary action. The solution according to the present invention gives direct information of ore characteristics, which allows a more timely control and optimization of the grinding circuit and of the comminution process.

The solution for controlling of a comminution process according to the present invention provides an on-line measurement of the ore characteristics, e.g. ore hardness, in the continuously changing conditions. The measurement according to the present invention is used for improving the performance of the grinding circuit and of the comminution process, and also for providing feedback to mining operations, and for providing additional information for the subsequent enrichment process, e.g. flotation.

The solution for controlling of a comminution process according to the present invention provides a more accurate and reliable measurement data and information on rock size distribution and characteristics of the ore conveyed from the crusher to the grinding mill. The comminution process can therefore be continuously and adequately controlled, there is no need for frequent calibration.

The solution for controlling of a comminution process according to the present invention provides a more detailed view of the entire comminution process with a thorough knowledge of the characteristics of the ore conveyed from the crusher to the grinding mill. This enables a substantially better control of a comminution process.

By achieving a substantially better control of a comminution process in general; also the crushing process and more importantly the grinding process can be better and more efficiently controlled. This brings a lot of savings through more efficient use of energy and process ore.

With the help of the solution according to the present invention the manufacturers of comminution process equipment will be able to provide comminution process equipment arrangements with having more reliable measurement data and information on the characteristics of the ore conveyed from the crusher to the grinding mill of grinding circuit with better measurement accuracy and reliability. The solution according to the present invention may be utilised in any kind of comminution process equipment.

It will be obvious to a person skilled in the art that, as the technology advances, the inventive concept can be implemented in various ways. The invention and its embodiments are not limited to the examples described above but may vary within the scope of the claims.

The invention claimed is:

1. A method for controlling a comminution process having a grinding circuit wherein the method comprises:

utilizing an imaging system to provide a measurement for first data for three-dimensional reconstruction of incoming ore to the grinding circuit;

utilizing a particle size analysis equipment to provide a measurement for particle size data for calculation of a particle size characteristic value of outgoing ore the grinding circuit;

receiving a particle size distribution profile of incoming ore, the particle size distribution profile of incoming ore being determined from the first data for three-dimensional reconstruction of incoming ore;

receiving a particle size characteristic value of outgoing ore, the particle size characteristic value of outgoing ore being calculated based on the measured particle size data;

calculating ore characteristics data based on the particle size distribution profile and the particle size characteristic value, the ore characteristics data identifying the ore hardness, which is calculated over the whole grinding circuit that is in continuous operation; and controlling the grinding circuit in the comminution process based on the calculated ore characteristics data.

2. The method according to claim 1, wherein the method comprises:

reconstructing a three-dimensional reconstruction of incoming ore from the first data for three-dimensional reconstruction of incoming ore; and calculating a particle size distribution profile of incoming ore based on the three-dimensional reconstruction of incoming ore.

3. The method according to claim 1, wherein the method comprises:

calculating the particle size characteristic value of outgoing ore based on the measured particle size data.

4. The method according to claim 1, wherein the grinding circuit comprises:

at least two groups of grinding mills arranged in series, each one of the at least two groups of grinding mills comprising at least one grinding mill; and at least one classification block, each one of the at least one classification block comprising at least one classification sorter.

5. The method according to claim 1, wherein the incoming ore is conveyed by a conveyor and that the imaging system is placed in the vicinity of the conveyor.

6. The method according to claim 1, wherein the method comprises:

receiving comminution process data for controlling the comminution process, the comminution process data including one or more of the following data: ore mass feed, density, water addition, ball addition, pebbles feed, grinding mill speed, grinding product size, grinding mill power draw, grinding mill torque, grinding mill bearing pressure and grinding mill charge.

7. The method according to claim 1, wherein the method comprises:

calculating control value data for controlling a crushing circuit and/or for controlling a grinding circuit.

8. The method according to claim 1, wherein the method comprises:

sending control signaling and/or data signaling to a crushing circuit, and/or to the grinding circuit.

9. An arrangement for controlling a comminution process having a grinding circuit wherein the arrangement comprises:

an imaging system for providing a measurement for first data for three-dimensional reconstruction of incoming ore to the grinding circuit;

a particle size analysis equipment for providing a measurement for particle size data for calculation of a particle size characteristic value of outgoing ore from the grinding circuit;

an ore characteristics data calculation block for receiving a particle size distribution profile of incoming ore, and a particle size characteristic value of outgoing ore, the particle size distribution profile of incoming ore being determined from the first data for three-dimensional reconstruction of incoming ore and the particle size characteristic value of outgoing ore being calculated based on the measured particle size data, wherein the ore characteristics data calculation block is adapted to calculate ore characteristics data based on the particle size distribution profile and the particle size characteristic value, the ore characteristics data identifying the ore hardness which is calculated over the whole grinding circuit that is in continuous operation; and a control block for controlling the grinding circuit in the comminution process based on the calculated ore characteristics data.

10. The arrangement according to claim 9, wherein the grinding circuit comprises:

at least two groups of grinding mills arranged in series, each one of the at least two groups of grinding mills comprising at least one grinding mill; and an at least one classification block, each one of the at least one classification block comprising at least one classification sorter.

11. The arrangement according to claim 9, wherein the imaging system is placed in the vicinity of a conveyor adapted to convey the incoming ore.

12. The arrangement according to claim 11, wherein the imaging system comprises at least one imaging device and the at least one imaging device acquires the first data for three-dimensional reconstruction of incoming ore as the incoming ore is exiting the conveyor.

13. The arrangement according to claim 9, wherein the control blocks receives comminution process data for controlling the comminution process, the comminution process data including one or more of the following data: ore mass feed, density, water addition, ball addition, pebbles feed, grinding mill speed, grinding product size, grinding mill power draw, grinding mill torque, grinding mill bearing pressure and grinding mill charge.

14. The arrangement according to claim 9, comprising at least one calculation block for calculating the particle size distribution profile of incoming ore and/or the particle size characteristic value of outgoing ore.

15. The arrangement according to claim 9, wherein the control block sends control signaling and/or data signaling to a crushing circuit and/or to the grinding circuit.

* * * * *